United States Patent [19]

Hemphill

[11] Patent Number: 4,516,339

[45] Date of Patent: May 14, 1985

[54] COMBINATION EXCAVATING BUCKET, SHANK AND DIGGING TEETH

[75] Inventor: Charles W. Hemphill, Duncanville, Tex.

[73] Assignee: GH Hensley Industries, Inc., Dallas, Tex.

[21] Appl. No.: 572,592

[22] Filed: Jan. 19, 1984

Related U.S. Application Data

[63] Continuation of Ser. No. 86,018, Oct. 17, 1979, abandoned.

[51] Int. Cl.[3] ..... E02F 9/28

[52] U.S. Cl. ..... 37/141 R; 37/141 T; 37/142 R

[58] Field of Search ..... 37/141 R, 141 T, 142 R, 37/142 A, 115-117

[56] References Cited

U.S. PATENT DOCUMENTS 2,217,347 10/1940 Morrow ..... 37/142 R
2,418,320 4/1947 Simmons ..... 37/142 R X
3,622,206 11/1971 Krekeler ..... 37/142 A X
4,037,337 7/1977 Hemphill ..... 37/142 R X

FOREIGN PATENT DOCUMENTS 2258042 5/1973 Fed. Rep. of Germany .... 37/142 R

*Primary Examiner*—E. H. Eickholt
*Attorney, Agent, or Firm*—Hubbard, Thurman, Turner & Tucker

[57] ABSTRACT

A combination of digging teeth, mounting shank, and backhoe bucket. The shank of each tooth has a rear part by which it can be permanently affixed to the bucket lip. The forward part of the shank has a pocket formed therewithin of a particular configuration which receives a digging tooth in close tolerance relationship therewithin such that a forward marginal part of the tooth extends forwardly from the bucket lip and engages the earth. Each opposed marginal end of each of the teeth has identical cutting edges formed thereon so that a tooth can be reversed as well as being substituted one for the other. The teeth are easily field dressed so as to restore a sharp cutting edge thereon.

3 Claims, 18 Drawing Figures

COMBINATION EXCAVATING BUCKET, SHANK AND DIGGING TEETH

REFERENCE TO RELATED PATENTS AND PATENT APPLICATIONS

This application is a continuation of application Ser. No. 86,018, filed Oct. 17, 1979, and now abandoned.

My previously issued U.S. Pat. Nos. 4,123,861; 4,117,611; 4,098,013; 4,037,337; and my copending patent application Ser. No. 086,017 filed Oct. 17, 1979, now U.S. Pat. No. 4,321,762; and the art of record cited therein.

BACKGROUND OF THE INVENTION

The backhoe-type digging machine excavates material from the earth in an efficient and rapid manner. The backhoe machines are available in various different sizes and sometimes cost more than a quarter million dollars. Hence, the hourly cost of operating the large backhoe bucket is astronomical; but on the other hand, the cost is very little compared with the results, and especially the results when contrasted with other methods of excavating earth.

The backhoe bucket design directly governs the efficiency of operation of the entire backhoe machine. The design of the digging teeth is directly related to the overall efficiency of a particular bucket. The condition of the digging teeth can influence the digging efficiency more than 50 percent, depending upon the type of formation being excavated. In some instances, as the digging teeth progressively wear, the efficiency can drop from 300 feet of ditch per day, down to less than 100 feet of ditch per day. Accordingly, it is desirable that the backhoe bucket be provided with a bucket of efficient design, having sharp digging teeth thereon which likewise are of optimum design respective to the bucket and to the formation being excavated.

Digging teeth which are low in cost and which may be maintained in good cutting condition is the subject of the present invention.

SUMMARY

This invention comprehends a combination backhoe bucket, tooth-receiving shanks, and digging teeth therefor. The invention further comprehends a combination shank and digging tooth therefor.

The tooth-receiving shank of the present invention comprises an elongated main body having a forward and rear portion aligned respective to a bucket so that a tooth mounted within a tooth-receiving pocket thereof is disposed forwardly of the bucket in aligned relationship respective to the direction of travel of the bucket. The tooth has a main body which is a polygon in cross-section. The polygon preferably is a quadrilateral, and more specifically is square in cross-sectional area. The opposed ends of the teeth are provided with identical cutting edges by the formation of parallel oblique faces arranged parallel to one another and defining the extremities of the tooth.

The oblique face preferably is a plane in the form of a diamond, with each corner of the diamond being one corner of the quadrilateral or square.

The configuration of the pocket is complementary to the configuration of either marginal end of a tooth so that the cutting face, cutting edge, and side walls of the tooth are received in close tolerance relationship with complementary arranged wall surfaces of the pocket.

The foregoing description of a pocket and tooth enables the digging teeth to be reversed within a pocket of a shank, thereby providing each of the teeth with dual cutting edges, and enabling any one of the teeth to be interchanged for another, as well as being reversed as may be required as the cutting edge is worn.

This remarkable configuration of a digging tooth further enables the cutting edges thereof to be resurfaced or dressed in the field so that the digging bucket is essentially provided with an inexhaustible supply of sharp digging teeth.

The teeth of this invention are fabricated from an elongated piece of metal stock of satisfactory alloy, which has been normalized and sawed at spaced intervals, with each of the saw lines being arranged parallel to one another and defining the face of the teeth. The teeth are subsequently heat treated to achieve optimum hardness.

Accordingly, a primary object of the present invention is the provision of a backhoe bucket, shank, and tooth combination which enables any one tooth to be exchanged for any other tooth, as well as enabling each of the teeth to be reversed within a pocket in order to present a new cutting edge forwardly of the bucket.

Another object of the invention is to provide a tooth and shank combination, wherein the tooth has cutting edges formed on opposed marginal ends of the cutting teeth, and with the shank having a pocket made complementary respective to either marginal end of the tooth.

A further object of this invention is to disclose and provide a tooth and pocket combination in which the digging tooth is provided with a cutting edge at each extremity thereof so that either cutting edge can be utilized by reversing the tooth within the pocket.

A still further object of this invention is to provide a tooth and shank combination which enables digging loads encountered by the cutting edge of the tooth to be transferred into the shank and then into the bucket in an improved and unusual manner.

Another and still further object is to provide a tooth and shank combination which enables the digging tooth to be reversed within a pocket of the shank to present a new cutting edge, and which furthermore enables the cutting edge of the tooth to be field dressed in an easy and efficient manner.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENT

Figure 1:
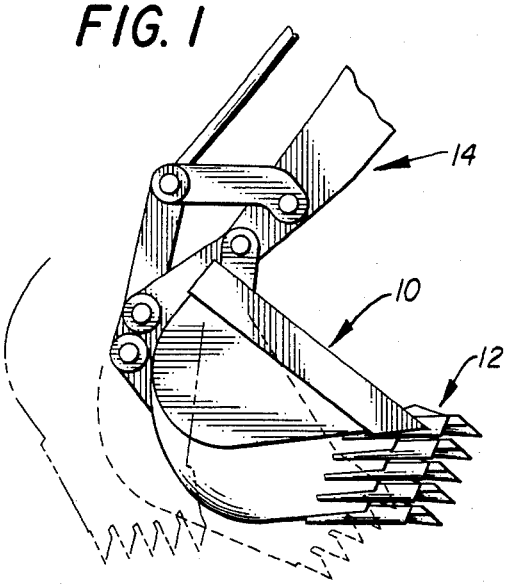
FIG. 1 is a broken, side elevational view of a combination backhoe bucket, shank, and tooth made in accordance with the present invention.
Figure 3:
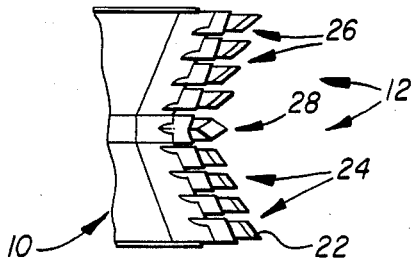
FIG. 3 is a reduced, broken, top view of the apparatus disclosed in FIG. 2.

FIG. 1 discloses a backhoe bucket 10, preferably made in accordance with my previous U.S. Pat. Nos. 4,037,337 and 4,123,861. The bucket includes a plurality of shanks and teeth, generally indicated by the numeral 12, positioned at the forward end of the bucket. The bucket is attached to the dipper stick 14 of a backhoe (not shown).

Figure 2:
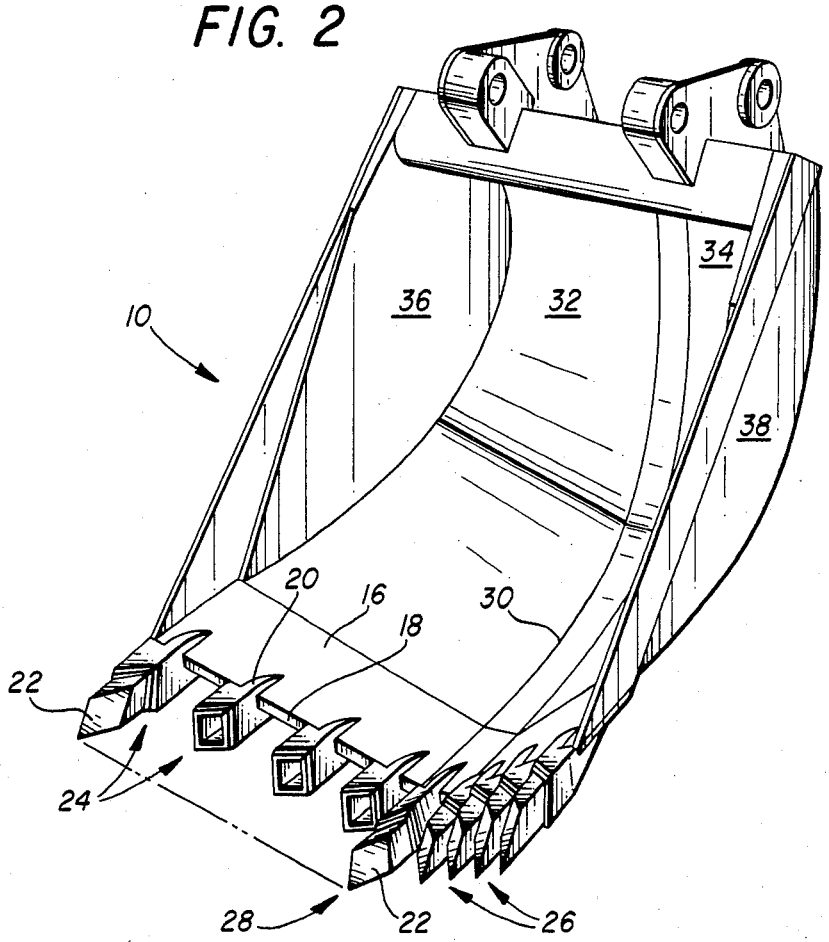
FIG. 2 is an enlarged, perspective view of the digging bucket seen in FIG. 1.
Figure 4:
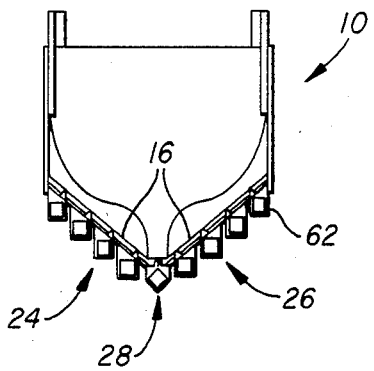
FIG. 4 is a reduced, front view of the apparatus disclosed in FIG. 2.
Figure 5:
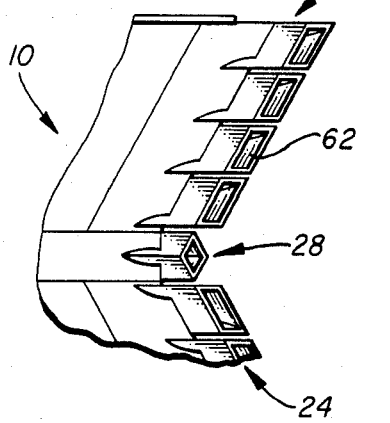
FIG. 5 is an enlarged, broken, top plan view of the apparatus disclosed in FIG. 4.
Figure 6:
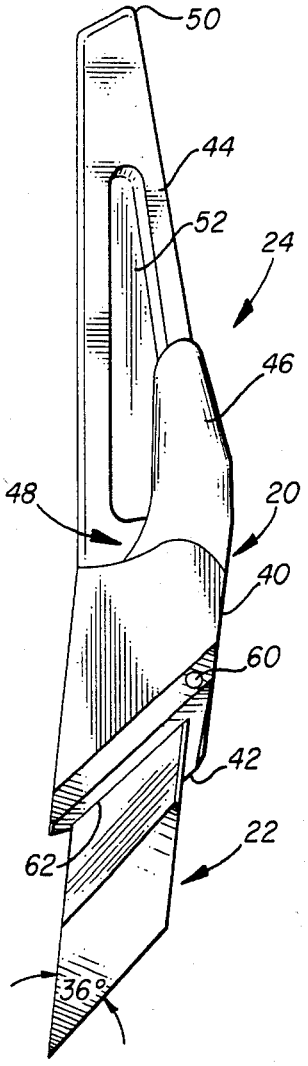
FIGS. 6, 7, and 8, respectively, are top and side elevational views of the digging teeth disclosed in the foregoing figures.

As best seen in FIG. 2, together with other figures of the drawings, the bucket includes a lip 16 having a front edge 18. A plurality of teeth-receiving shanks 20 each has a rear marginal edge portion affixed to the forward marginal edge portion of the lip. A tooth 22 has a rear marginal length which is received within a pocket formed within the forward marginal edge portion of each of the shanks. For purposes of illustration, some of the shanks in FIG. 2 have the teeth removed therefrom.

In FIGS. 2–5, it will be noted that the bucket lip is in the form of a "V", with one side of the V having a plurality of teeth and shanks 24 attached thereto, the other side of the V-shaped lip has a plurality of teeth and shanks 26 affixed thereto, with there being a central tooth and shank at 28 connected along the apex 30 of the V. The apex also forms the keel or central portion of the bucket. The keel extends longitudinally of the bucket, while the lip extends laterally of the bucket. The shanks at 24 are mirror images of the shanks at 26, and the shank at 28 is made more or less symmetrical. Therefore, the shanks at 24 and 26 are asymmetrical.

One side 32 of the V-shaped bucket bottom is connected to the other side 34 of the V-shaped bottom, and the entire bottom is connected to opposed bucket side walls 36 and 38.

FIGS. 6–11 illustrate the details of the teeth and shanks seen at 24, 26, and 28 in the previous figures of the drawings. As particularly seen in FIG. 6, the shank 24 has a main body 40 which terminates forwardly at shoulder 42. The rear marginal portion of the shank is in the form of a lower tang 44 having a rear marginal end spaced from upper tang 46, thereby leaving a lip-receiving opening or slot 48 between the upper and lower tangs.

The shank has a trailing end 50 which is also the free terminal end of the lower shank. A lightening hole 52 is formed in the upper face of the lower tang to conserve material and weight.

Figure 7:
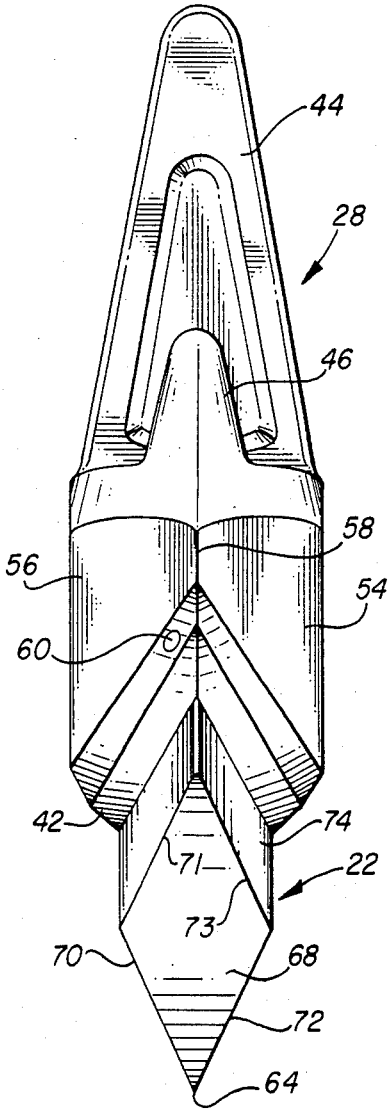
Figure 8:
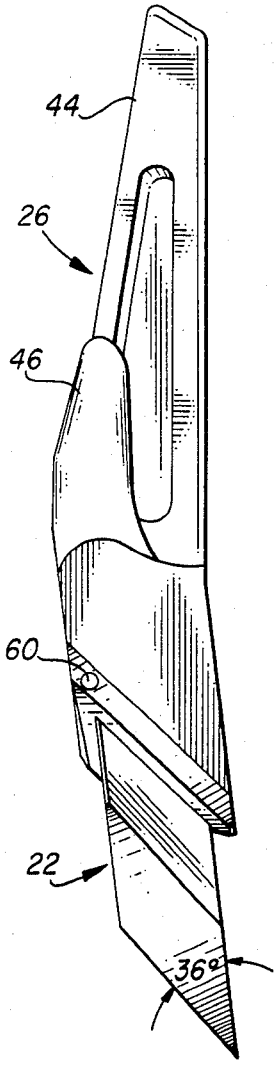
Figure 9:
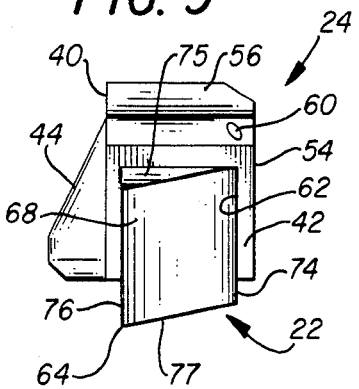
FIGS. 9, 10, and 11, respectively, are front elevational views of the combination disclosed in FIGS. 6, 7, and 8, respectively.
Figure 10:
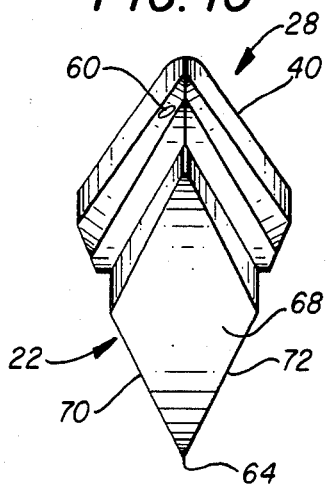
Figure 11:
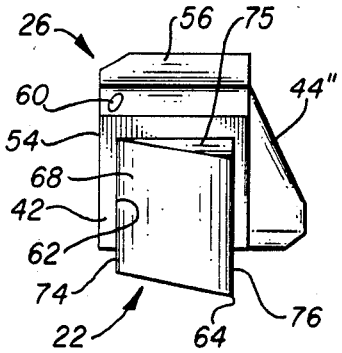
Figure 12:
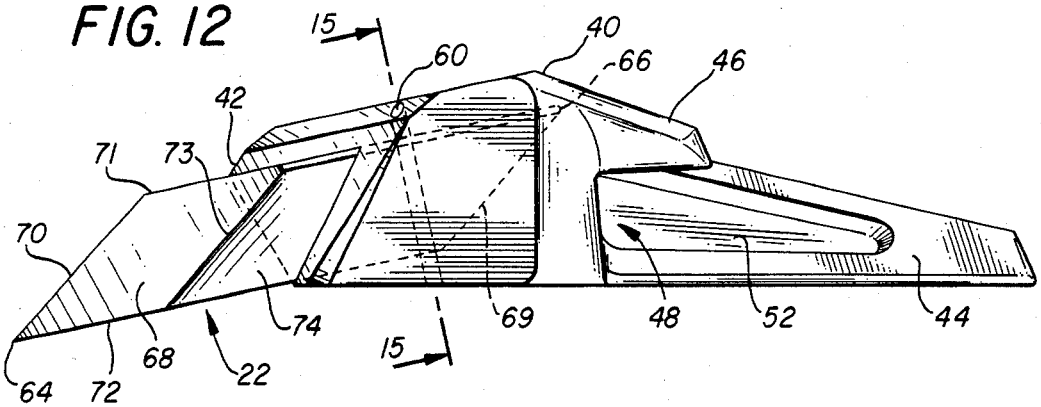
FIG. 12 is a side elevational view of the apparatus disclosed in FIG. 8.
Figure 13:
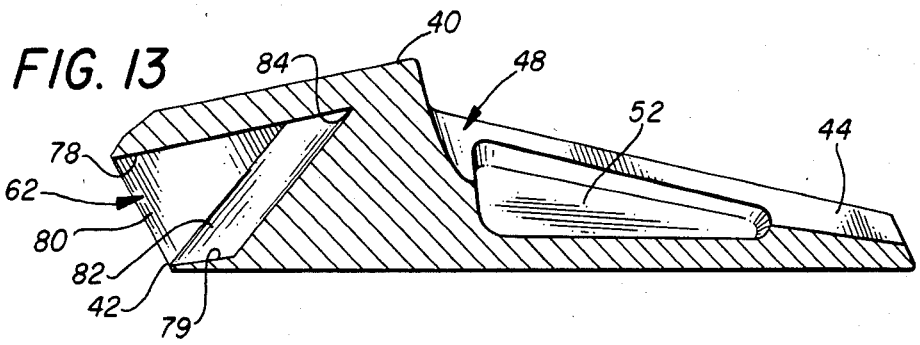
FIG. 13 is a cross-sectional view of part of the apparatus disclosed in FIG. 12.
Figure 14:
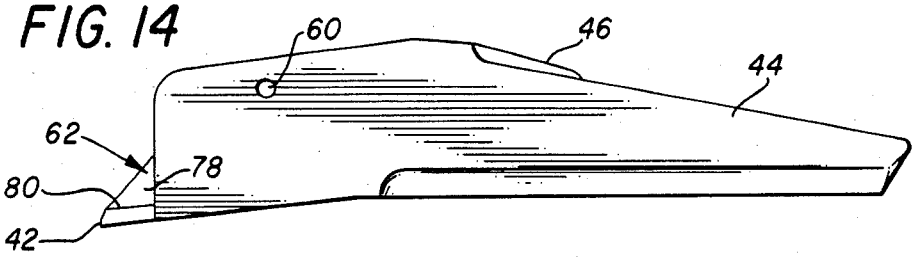
FIG. 14 discloses the opposite side of part of the apparatus disclosed in FIG. 12.
Figure 15:
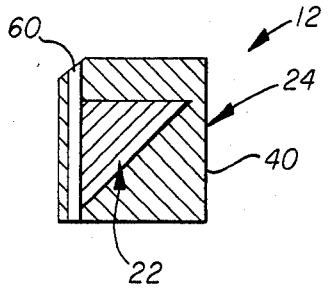
FIG. 15 is a cross-sectional view taken along line 15—15 of FIG. 12.
Figure 16:
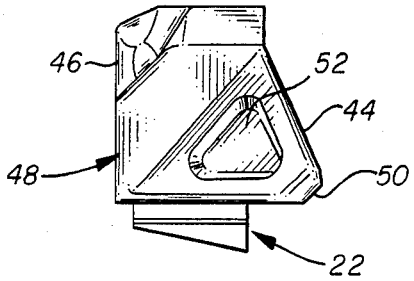
FIG. 16 is a rear view of the apparatus disclosed in FIG. 12.

As seen in FIG. 7, the main body of each of the shanks is provided with sloped walls 54 and 56 which are joined at apex 58. A pin hole 60 extends through the shank and engages a tooth which may be contained therewithin so that the tooth is removably mated within the pocket of the shank. The entrance into the pocket is defined by the shoulder 42.

In FIGS. 12–16, in conjunction with FIGS. 6–11, the foward tip 64 defines one terminal end of the tooth, while an identical tip 66 forms the opposite terminal end of the tooth. The tip 64 also defines the beginning of a face 68, and the face 68 forms the forward cutting edges of the tooth. The main body of the tooth includes side walls 74, 75, 76, 77, which terminate forwardly in the before mentioned edge portions and which terminate rearwardly in identical edge portions. The face 68 is parallel to the face 69.

The pocket 62 includes a roof 78, a floor 79, side walls 80, and a rear wall 82. The tip 66 of the tooth is received at apex 84 of the rearwardly converging walls.

Accordingly, the pocket 62 is made complementary respective to a marginal end of the tooth, with the side walls of the tooth being received in close tolerance relationship respective to the side walls of the pocket, and with the face of the tooth being received in abutting relationship respective to the rear wall 84 of the pocket, and with the tip 66 of the tooth being received within the similarly contoured or complementary shaped apex 84.

Figure 17:
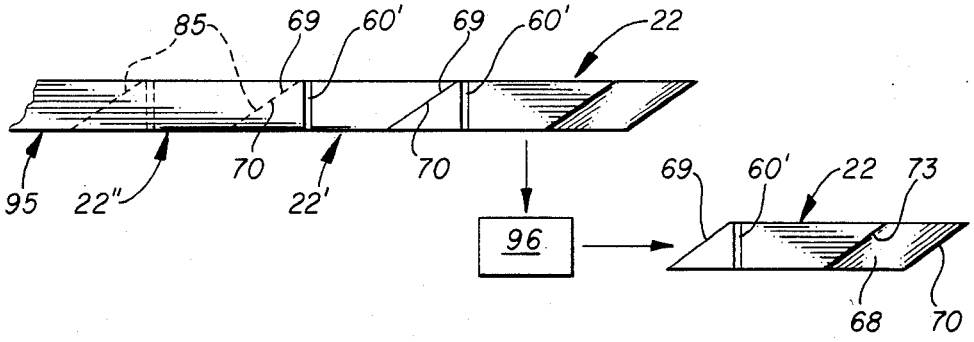
FIG. 17 diagrammatically illustrates a flow sheet of the manufacture of part of the apparatus disclosed in the foregoing figures; and, FIG. 18 is a schematical, cross-sectional view of a ditch which has been dug using the apparatus disclosed in FIG. 1.

In FIG. 17, there is disclosed an elongated, longitudinally extending length of suitable alloy steel 95 which has been normalized so that the steel is relatively soft and can be easily cut. The long, rectangular body of steel has been milled at spaced locations 60′ to provide a groove across one entire face of the tooth side wall. The groove 60′ registers with the pin hole 60 so that a rolled pin or the like can be driven through the pin hole 60 and groove 60′, thereby releasably affixing the tooth within the pocket of a shank.

The metal stock 95 is sawed along parallel saw lines 85 to provide a plurality of teeth 22, 22′, 22″, with each of the teeth being identical, and with the saw line defining the opposed cutting faces 68, 69 of the teeth.

After the metal stock 95 has been sawed into individual teeth, the individual teeth are heat treated at 96, thereby providing a heat-treated tooth 22 of suitable alloy which has been brought to optimum hardness, and which can be used in conjunction with a shank and bucket in accordance with the present invention.

Figure 18:
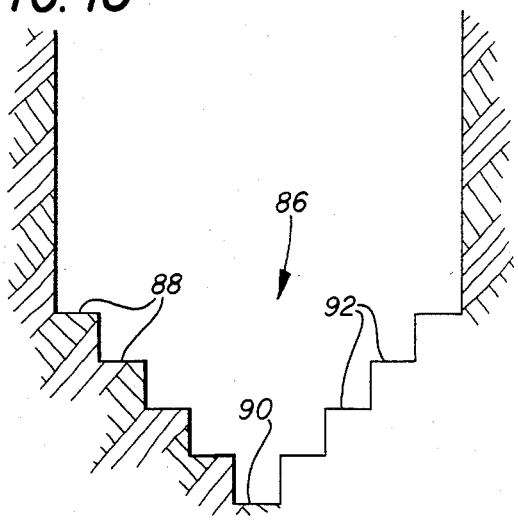

In FIG. 18, there is disclosed a ditch 86 which has been dug with the bucket of FIG. 2. It will be noted that the teeth 22 in FIG. 2 are arranged at 24 and form the ledges 88 of FIG. 18; and that the tooth 22 located at 28 in FIG. 2 has formed the bottommost ledge 90, while the teeth 22 located at 26 in FIG. 2 have dug ledges 92 of FIG. 18. The cutting face of the teeth at 24 is aligned such that the face slopes upwardly towards the top of the bucket and inwardly towards the central tooth 28. The teeth at 26 are located opposite to the teeth at 24 so that the face of the teeth 26 also slopes upwardly towards the top of the bucket and inwardly towards the central tooth 28. This arrangement of the cutting faces of the teeth causes excavated material to flow into the bucket in a superior manner.

It will be noted that the central tooth 28 is located inwardly of the other teeth 24 and 26, with adjacent teeth being located forwardly and above the tooth 28, in accordance with my previously issued U.S. Pat. No. 4,037,337.

All of the teeth at 24, 26, and 28 are identical; and therefore, any one tooth can be substituted for any other tooth. Moreover, any tooth can be removed from a pocket and reinstalled with the previous digging end being inserted into the pocket in the manner of FIG. 12. This presents a new cutting edge, thereby providing each of the teeth with dual cutting surfaces which may be selectively employed whenever needed by reversing any one tooth within its socket.

Looking again now to FIGS. 2 and 18, it will be noted that the central tooth 28 digs a groove 90 having two side walls and a bottom, while the remaining teeth dig only a side wall and bottom, as noted at 88 and 92. The outermost teeth dig in advance of the innermost teeth and therefore wear at a faster rate. Accordingly, it is sometimes advantageous to be able to interchange some of the intermediate teeth for the outermost and innermost teeth.

The teeth of the present invention are low in cost; and therefore, an ample supply of teeth can be maintained available for use. This enables one set of teeth to be dressed while another set of teeth is being used by the backhoe bucket. As the teeth become dull, they are easily and quickly reversed within their pockets, and when both cutting edges have been dull, the teeth may be field dressed, thereby presenting a new cutting edge on the old teeth by the mere employment of a common bench grinder.

As seen illustrated in the various figures of the drawings, the main body of the tooth is polygonic in cross-section. The polygon preferably is a quadrilateral which has been truncated to form two oblique faces spaced apart and placed in parallel relationship respective to one another, with each of the faces being defined by a plurality of cutting edges. More specifically, the quadrilater is a truncated, elongated, solid length of steel or steel alloy having the oblique face arranged in a plane which lies 36° respective to the bottom wall of the tooth, and also arranged at an angle of 36° respective to a side wall thereof, so that the face slants upwardly back towards the bucket and inwardly towards the center of the bucket.

I claim:

1. In an earth excavating apparatus, a bucket having a generally V-shaped lip formed along a forward end of said bucket for supporting a plurality of digging teeth for digging a ditch in the earth, at least a portion of each of said teeth projecting forwardly of said lip in the direction of digging into the earth, said each of said teeth being identical to the other teeth and being characterized by:

a tooth body formed as a quadrilateral in lateral cross-section having four sidewalls and spaced apart planar parallel faces, both of said faces terminating in opposite directions at opposed tips forming opposite terminal ends of said tooth, and both of said faces forming opposed cutting edges which diverge away from said tips, respectively, in a direction opposite to the direction of cutting so that said tooth can be reversely disposed on said bucket for cutting the earth with one or the other ends of said tooth;

support means on said lip for each of said teeth, said support means including a shank member including a shank body defining a pocket, said pocket being formed by a roof, a floor, and sidewalls for receiving said tooth in close tolerance relationship with respect to the corresponding sidewalls of said tooth body defining said quadrilateral, and said pocket being delimited by a rear wall converging to an apex so that said pocket is formed to receive on one end of a tooth with one of said faces being received in abutting relationship with said rear wall in accordance with which of said ends of said teeth are disposed in said pockets, respectively and with a tip of said tooth being received within said apex of said pocket;

means for retaining each tooth on its associated shank including a groove formed in a sidewall of said tooth and a hole formed in said shank body for receiving a retaining pin for retaining said tooth on said shank in one or the other of reversely disposed positions with an end of said tooth secured in said pocket and one or the other of said faces in abutting relationship with said rear wall so that said teeth can be located in a predetermined position in said pockets by said one or the other of said faces and interchanged between shanks even though the cutting edges or tip formed by said faces, respectively, become worn or broken; and said shanks are disposed on said lip to provide an array of teeth with a central tooth having its cutting face facing upwardly and slanting upwardly toward said bucket when said bucket is oriented to dig a ditch in the earth having a generally horizontal open side, and opposed sets of teeth on opposite sides of said central tooth arranged so as to have their cutting faces aligned to slope upwardly toward said bucket and inwardly toward said central tooth.

2. The invention set forth in claim 1 wherein:

said shank body of each of said shanks terminates in one end in upper and lower tangs defining with said shank body a slot for receiving said lip.

3. In an earth excavating apparatus comprising a bucket having a lip formed along a forward end of said bucket, said lip comprising support means for advancing a plurality of digging teeth in a direction to cut into the earth, means on said lip for receiving in supporting relationship thereto a plurality of digging teeth in such a way that at least a portion of said teeth project forwardly of said lip in the direction of digging into the earth, each tooth being characterized by:

a tooth body formed as a quadrilateral in lateral cross-section having four sidewalls and spaced apart planar parallel faces, both of said faces terminating in opposite directions at opposed tips forming opposite terminal ends of said tooth, and both of said faces forming opposed cutting edges which diverge away from said tips, respectively, in a direction opposite to the direction of cutting so that said tooth can be reversely disposed on said lip for cutting the earth with one or the other ends of said tooth;

a shank member including a shank body defining a pocket, said pocket being formed by a roof, a floor, and sidewalls for receiving said tooth in close tolerance relationship with respect to the corresponding sidewalls of said tooth body defining said quadrilateral, and said pocket being delimited by a rear wall converging to an apex so that said pocket is formed to receive one end of said tooth with one of said faces being received in abutting relationship with said rear wall in accordance with which of said ends of said tooth is disposed in said pocket and with a tip of said tooth being received within said apex of said pocket;

means for retaining said tooth on said shank member in one or the other of reversely disposed positions with an end of said tooth secured in said pocket and one or the other of said faces in abutting relationship with said rear wall so that said tooth can be located in a predetermined position in said pocket by said one or the other of said faces even though the cutting edges or tip formed by said faces, respectively, become worn or broken; and said lip supports a plurality of said shank members, each of said shank members supporting one of said teeth whereby said teeth are arranged in an array of identical teeth in such a way that the tip of each tooth oriented for cutting the earth projects forwardly of said lip with a central tooth having its cutting face facing upwardly and slanting upwardly toward said bucket when said bucket is oriented to dig a ditch in the earth having a generally horizontal open side, and opposed sets of teeth are arranged on opposite sides of said central tooth so as to have their cutting faces aligned to slope upwardly toward said bucket and inwardly toward said central tooth.

* * * * *